United States Patent [19]

Roberson et al.

[11] Patent Number: 4,585,583

[45] Date of Patent: Apr. 29, 1986

[54] IN SITU SOLIDIFICATION OF ION EXCHANGE BEADS

[75] Inventors: Keith Roberson, Freeland; Don L. Stevens, Sanford; Harold E. Filter, Midland, all of Mich.

[73] Assignee: The Dow Chemical Company, Midland, Mich.

[21] Appl. No.: 380,963

[22] Filed: May 24, 1982

[51] Int. Cl.[4] ..... G21F 9/28; G21F 9/34

[52] U.S. Cl. ..... 252/628; 252/626; 252/633

[58] Field of Search ..... 252/628, 626, 633

[56] References Cited

U.S. PATENT DOCUMENTS

| | | | |
|---|---|---|---|
| 3,658,179 | 4/1972 | Baumann et al. | 252/628 |
| 4,077,901 | 3/1978 | Arnold et al. | 252/628 |
| 4,107,044 | 8/1978 | Levendusky | 252/628 |
| 4,122,048 | 10/1978 | Buchwalder et al. | 252/631 |
| 4,131,563 | 12/1978 | Bahr et al. | 252/628 |
| 4,436,655 | 3/1984 | Masotto et al. | 252/628 |

OTHER PUBLICATIONS

Lerch et al, "Treatment and Immobilization of Intermediate-Level Radioactive Wastes", in Carter et al, Eds., *Management of Low-Level Radioactive Waste*, vol. 2, Pergamon Press, N.Y. (1979), pp. 540-545.

*Primary Examiner*—Teddy S. Gron
*Assistant Examiner*—Virginia B. Caress
*Attorney, Agent, or Firm*—B. M. Kanuch

[57] ABSTRACT

A method is disclosed for encapsulating and solidifying spent ion exchange beads contained in a container to form an ion exchange bed with a solidification resin without the necessity for applying shear in the bed by an external force such as by a mixing impeller. A solidification resin is flowed through the ion exchange bed by plug flow to intermix with and encapsulate each ion exchange bead therein. The resin is cured to form a uniform, solidified monolith of said ion exchange beads in said container. When the ion exchange bed contains free water, the process also effects the removal of substantial portions of the free water and also emulsifies and solidifies free water remaining in the bed.

23 Claims, 1 Drawing Figure

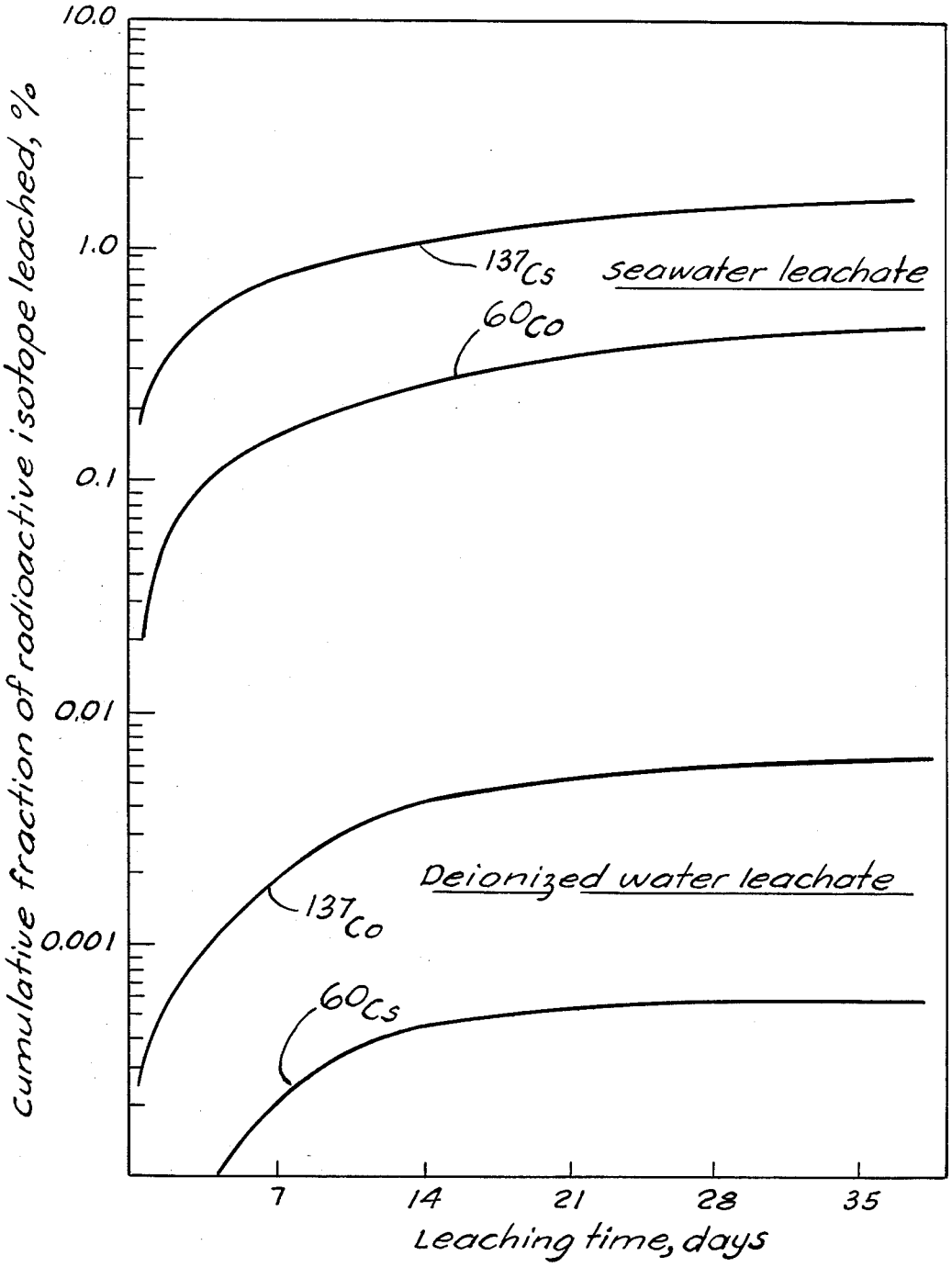
10.0
1.0
0.1
0.01
0.001
Cumulative fraction of radioactive isotope leached, %
137Cs
seawater leachate
60Co
Deionized water leachate
137Co
60Cs
7
14
21
28
35
Leaching time, days

IN SITU SOLIDIFICATION OF ION EXCHANGE BEADS

BACKGROUND OF THE INVENTION

The use of ion exchange beads to clean up aqueous solutions is a well known art. The ion exchange beads are usually employed in the form of uniformly sized particles or beads. In these techniques, anionic, cationic or mixtures of ionic species are removed from aqueous solutions by contacting the solution with the ion exchange beads usually in the form of a bed of the beads which exchanges desirable or non-harmful ionic species for the non-desirable ion species in the solution. Such clean-up techniques are used in the metal finishing industry, municiple water clarification plants, nuclear power industry and the like. One of the most frequent means of providing contact between the ion exchange beads and the solution is to flow the solution through a column which is packed with the ion exchange beads to form an ion exchange bed. When the ion exchange bed becomes spent (i.e., no longer has capacity for removing ionic species from the solution) it may be regenerated or discarded. In some areas such as when the ionic species are toxic, e.g., lead, chromium, uranium, radioactive or the like, it is desirable to discard the ion exchange bed at a suitable disposal site. U.S. Pat. No. 3,664,870 teaches the use of solvents and ion exchange beds for removing radioactive deposits from cooling systems of nuclear reactors.

Present techniques for disposal generally comprise dewatering the ion exchange bed as best as possible and placing the spent ion exchange beads in suitable containers for disposal. The ion exchange beads are usually associated with a substantial amount of free water which is difficult to remove from the beads. In some instances, the container along with the ion exchange bed is disposed of in its entirety. However, with increasing interest in environmental quality, an emphasis has been placed on disposing of such spent ion exchange beads in a form to prevent leaching of toxic ions from the container and into the environment. One means for reducing the rate at which leaching occurs is to encapsulate the ion exchange beads in a suitable binder material such as cement, various resins such as vinyl ester resins, unsaturated polyester resins, and the like.

One of the more successful methods and solidification resins for encapsulating ion exchange beads is taught in U.S. Pat. No. 4,077,901. This patent describes a method whereby the beads are encapsulated in a vinyl ester resin, or in an unsaturated polyester resin, or in a mixture of the two types of resins. Useful solidification resins are taught in U.S. Pat. Nos. 3,792,006 and 3,442,842. In this process the ion exchange beads are removed from the original container (e.g., column, etc.) and then mixed with the solidification resin in a suitable container by using a means for agitating the beads and resin to provide sufficient shear to emulsify free water remaining with the beads and form a uniform suspension of the solidification resin and beads. This process necessitates further handling of the toxic materials, the use of impellers and complicated mixing equipment, and the emulsification of substantial amounts of water along with the beads. Much of the solidification resin is used to solidify the free water. This increases the volume of solidification resin needed and therefore the overall cost of solidifying and disposing of these wastes. It would be desirable to be able to dewater, where necessary, and encapsulate spent ion exchange beads in a container without the necessity for agitating the mixture such as with an impeller and without the need for elevated temperatures such as employed in the process taught in U.S. Pat. No. 4,119,560. The present invention provides a method of doing this.

THE INVENTION

The present invention concerns the encapsulation and solidification of ion exchange beads which have been employed to remove ionic species from an aqueous solution. The beads may be contaminated with toxic ions, such as radioactive ions, poisonous ions and the like. Improvements in dewatering if free water is present, mixing and handling are achieved.

In the practice of the invention, ion exchange beads contained in a container to form a bed are encapsulated in-situ in the container by introducing, in plug flow, a sufficient quantity of a liquid solidification resin comprising a vinyl ester resin, an unsaturated polyester resin or a mixture of the two, and a suitable catalyst to cause the resin to cure, into and through the ion exchange beads to intermix with and encapsulate the ion exchange beads. The ion exchange beads are surrounded by and enclosed by the resin, which after curing, forms a uniform solidified mixture of said beads and resin in the container. When free water is associated with the beads, some free water is forced from the bed and some free water is emulsified into the solidification resin without the application of an external shearing force being applied to the mixture and without the need for temperature conditions sufficient to evaporate the water. The container along with the encapsulated and solidified ion exchange beads can be then disposed of in any suitable manner.

The solidification resin is prepared by premixing a resin with a suitable polymerization catalyst, and a promoter if necessary. The viscosity of the solidification resin should be such that the resin will freely flow through the ion exchange bed with a substantially even front (plug flow) to force free water, if any, from the bed and surround and fill substantially all the voids in the ion exchange bed. By plug flow it is meant that the solidification resin spreads out inside the container to the walls thereof and flows through the container and bed as a plug, the outside walls of which conform substantailly to the walls of the container. Once the bed has been encapsulated, the solidification resin is permitted to cure in the bed, i.e., polymerize in-situ, thereby to provide a uniform solidified mixture of said beads and said resin in the container. The mixture may also contain some free water emulsified in the solidification resin. By "free water" is meant that water in the ion exchange bed which is not bound internally in the individual ion exchange beads.

Since the solidification resin forces free water out of the ion exchange bed as it moves therethrough and since the solidification resin will also emulsify some of the free water a separate dewatering step is not necessary in the practice of the invention. Contaminated water removed from the bed can be emulsified into and solidified with the same resin in a separate container in a manner known in the art. Any water forced from the bed which is of sufficient purity can be employed in any desired manner. The solidified ion exchange bed, however, is essentially "liquid free".

By "liquid free" it is meant that the solidified bed will not weep or produce any substantial residual amounts of liquid upon standing after the solidification resin has cured. However, the solidified bed may contain emulsified water therein in such microdroplets that the solidified bed will not weep free water even when cut or broken. Normally, the individual ion exchange beads will contain water bound therein which is not affected by the practice of the present invention.

DRAWING

The FIGURE depicts a summary of leach data collected from solidification samples of radioactive contaminated ion exchange beads as described in Example 9.

DETAILED DESCRIPTION OF THE INVENTION

The solidification resin used in the process is a liquid thermosettable resin which includes vinyl ester resins, unsaturated polyester resins and mixtures of these resins.

The solidification resin that may be employed comprises a thermosettable resin composition of (1) a vinyl ester resin prepared by reacting about equivalent proportions of an unsaturated monocarboxylic acid and a polyepoxide resin, said vinyl ester resin containing

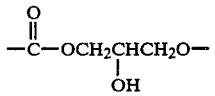

linkage groups and terminal, polymerizable vinylidene groups attached to the ester end of said linkage, or (2) an unsaturated polyester, or (3) mixtures thereof, and a catalyst for curing said resin. The resin composition is formulated such that the cure takes place under thermal and catalytic conditions such that the exotherm developed during the cure does not rise above the temperature at which the integrity of the encapsulating material is destroyed. Vinyl ester resins which are useful are taught, for example, in U.S. Pat. Nos. 3,367,992; 3,066,112; 3,179,623; 3,301,743; and 3,256,226, the teachings of which are specifically incorporated herein by reference.

Other vinyl ester resins that may be employed are those modified by reaction with dicarboxylic acid anhydrides, and various brominated vinyl ester resins.

A wide variety of unsaturated polyesters which are readily available or can be prepared by methods well-known to the art are also useful. Such unsaturated polyesters result from the condensation of polybasic carboxylic acids and compounds having two or more hydroxyl groups. Generally, in the preparation of suitable unsaturated polyesters, an ethylenically unsaturated dicarboxylic acid such as maleic acid, fumaric acid, itaconic acid or the like is interesterified with an alkylene glycol or polyalkylene glycol having a molecular weight of up to 2000 or thereabouts. Frequently, dicarboxylic acids free of ethylenic unsaturation such as phthalic acid, isophthalic acid, adipic acid, succinic acid and the like may be employed within a molar range of 0.25 to as much as 15 moles per mole of the unsaturated dicarboxylic acid. It will be understood that the appropriate acid anhydrides when they exist may be used and usually are preferred when available.

The glycol or polyhydric alcohol component of the polyester is usually stoichiometric or in slight excess with respect to the sum of the acids. The excess of polyhydric alcohol seldom will exceed 20–25 percent and usually is about 10–15 percent.

These unsaturated polyesters may be prepared by heating a mixture of the polyhydric alcohol with the dicarboxylic acid or anhydride in the proper molar proportions at elevated temperatures, usually at about 150° to 225° C. for a period of time ranging from about 1 to 5 hours. The condensation reaction is contained until the acid content drops to about 2 to 12 percent as COOH and preferably from 4 to 8 percent.

Polymerization inhibitors, commonly called process inhibitors, such as t-butyl catechol, monomethyl ether of hydroquinone (MEHQ) or hydroquinone, are advantageously added to prevent premature polymerization during the preparation of the vinyl ester resin or the unsaturated polyester.

Examples of unsaturated polyester resins that may be used in the process are described in Column 3, line 16 through Column 4, line 5 of U.S. Pat. No. 4,077,901. Such polyesters are made by reacting ethylenically unsaturated dicarboxylic acids or anhydrides with an alkylene glycol or polyalkylene glycol having a molecular weight of up to about 2,000. The teachings of this patent are specifically incorporated herein by reference.

Preferably, the thermosettable resin phase of the solidification resin comprises from about 40 to about 70 weight percent of the vinyl ester or unsaturated polyester resin and from about 60 to about 30 percent of a copolymerizable monomer. Suitable monomers must be essentially water insoluble to maintain the monomer in the resin phase when it comes into contact with water in the ion exchange bed to thereby form an emulsion with a portion of the water. Complete water insolubility is not required and a small amount of monomer dissolved in the emulsified water causes no harm.

Suitable monomers include vinyl aromatic compounds such as styrene, vinyl toluene, divinyl benzene, and the like. Other useful monomers include the esters of saturated alcohols such as methyl, ethyl, isopropyl, octyl, etc., with acrylic or methacrylic acid; vinyl acetate; diallyl maleate; dimethallyl fumarate; mixtures of the same and all other monomers which are capable of copolymerizing with the vinyl ester resin and are essentially water insoluble.

An emulsion of some free water from the ion exchange bed, with the vinyl ester resin, particularly those previously described, can be made without added emulsifier. Emulsions made with certain unsaturated polyester resins may require added emulsifier. Such emulsifiers are known in the art, and judicious selection can be made with simple routine experiments.

Catalysts that may be used for the curing or polymerization are preferably the peroxide and hydroperoxide catalysts such as benzoyl peroxide, lauroyl peroxide, t-butyl hydroperoxide, methyl ethyl ketone peroxide, t-butyl perbenzoate, potassium persulfate and the like. The amount of active catalyst added will vary, preferably, from about 0.25 to about 5 percent by weight of the resin phase. As will be more fully explained hereinafter, additional catalyst may be required if the ion exchange bed has not been completely spent prior to encapsulation since certain catalysts and/or promoters may be adsorbed onto the bed thus making them unavailable in the curing process. Also as explained hereinafter, additional amounts may be required if the pH of the water contained in the bed is very acid or basic.

Preferably, the cure of the resin is initiated at room temperature by the addition of known accelerating agents or promoters, such as lead, potassium or cobalt naphthenate, dimethyl aniline, N,N-dimethyl-p-toluidine and the like, usually in concentrations ranging from about 0.025 to about 5.0 weight percent of the resin phase of active promoter. As with the catalyst, the type of ion exchange resin bed, the pH of the water, and the degree of spentness of the bed may affect the quantity of promoter required. The promoter selected also depends on the specific catalyst used as is known to those skilled in the art of polymerization of unsaturated polyesters and vinyl ester resins.

The mixture of resin and ion exchange beads with or without emulsified water can be readily gelled in about 15 to about 90 minutes, depending on the temperature, the catalyst level and the promoter level, and cured to a hard solid in about one to four hours.

It is important that the type of catalyst, the catalyst concentration and type of promoter and promoter concentration be such that the exotherm developed during the cure of the resin does not rise above the temperature at which the integrity of the encapsulated material will be destroyed. Also, the time required to force the resin through the entire ion exchange bed must be determined and the quantity and type of catalyst and promoter should be selected so that the resin does not gel before the bed is substantially completely encapsulated.

Any of the commonly used ion exchange beads can be encapsulated according to the principles of the invention described herein. Cationic, anionic and mixed (cationic-anionic) ion exchange beds can be solidified. The chemical composition of the ion exchange beads is not critical and any of those commonly used can be treated according to the principles of the present invention. Ion exchange beads composed of the polymerization of polystyrene and chloromethylene; polystyrene cross-linked with divinyl benzene and sulfonated, and sulphonated phenol formaldehyde resin are examples of suitable resins. The beads preferably are substantially spent at least with respect to the chemicals employed as catalyst and promoter in the practice of the invention. If not completely spent the beads may be treated to spend the same or additional quantities of the catalyst or promoter, or both, may be employed to compensate for that which may be lost to the beads during the practice of the invention.

The size of the ion exchange beads in the bed is not critical but may dictate to some extent the viscosity of the resin which can be employed in order to flow the solidification resin through the bed as a plug. The particle size may also affect the pressure or vacuum required to force the resin through the bed. The viscosity of the resin should be within a range to permit the introduction into and through the bed with a substantially even front (e.g., plug flow) at practical pressures or vacuum. If the resin were to finger through the bed, portions of the bed may be left untreated with the resin mixture. A viscosity of about 40 to about 1000 centipoise, preferably from about 50 to about 400 centipoise measured on a Brookfield Viscosimeter at a temperature of about 25° C. is suitable.

The pH of the free water remaining in the bed may have an effect on the formation of an emulsion and/or the curing of the emulsion of the solidification resin and the water. With a vinyl ester resin, successful emulsions can be prepared with water having a wide pH range, e.g., from very acid, e.g., 0.5 to very basic, e.g., 13–14 pH. Polyesters are more sensitive to the pH of the water and emulsions can normally only be prepared with water having a pH of above 7.0, preferably about 7.0 to very basic, e.g., 13–14 pH. At the higher and lower pH conditions at which successful emulsions can be prepared, as set forth before, adjustments in the catalyst and promoter may be required to assure a proper cure. For example, at the lower and higher extremes of pH, 2 to 5 times the quantity of catalyst and promoter as previously described herein may be required to assure a proper cure.

The process may be employed to solidify the ion exchange beads, which have become radioactive, used in the nuclear industry, for example, in the decontamination process taught in U.S. Pat. No. 3,664,870, the teachings of which are specifically incorporated herein by reference. These teachings include the type of ion exchange beads employed, the process conditions and the like.

Some ion exchange beds contain activated charcoal as an added constituent. The process of the present invention can be employed to encapsulate certain of such beds. Some charcoals must be deactivated by treatment with a compatible organic material, such as acetone, lubricating oil and the like. Because activated charcoal varies so much from one source to another, pretesting of the ability of particular solidification resins to solidify such carbon beds should be carried out in order to determine which are most successful. It has been found that some activated charcoals can be easily solidified without treatment with an organic substance while others are very difficult to solidify even when treated with an organic material.

In the practice of the process of the present invention the solidification resin, having been premixed with a catalyst and, if necessary a promotor, is forced, e.g., by pumping with pressure or drawing by vacuum, through an ion exchange bed, contained in a demineralizer column or other container. The viscosity of the precatalyzed and promoted resin is selected so that interstitial free water in the resin bed is forced ahead of the resin front as it flows through the bed to thereby fill substantially all the voids in the bed with the solidification resin. The viscosity is also within a range that the resin can be flowed through the bed in plug flow. As previously indicated, plug flow means that the resin will essentially evenly fill the container from wall to wall and will flow through the entire bed in this form. A small amount of free water may be emulsified into the solidification resin through the shearing conditions set up by the flow of resin through the bed. The emulsion will cure in the same manner as the water-free resin. An emulsion provides an added advantage in that the emulsified water acts as a heat sink. An amount of free water above that which will form a stable emulsion must not be left in the bed after the solidification resin has been introduced therethrough since a stable emulsion may not be formed. From about 30 to about 70 percent by weight of water in the emulsion is preferable. Although satisfactory emulsions can be formed with less than about 30 percent water, with greater than about 75 percent water the emulsion becomes unstable and unemulsified free water may remain in the mass after the resin has cured. If the solidified mass is broken or cut, this free water may escape as contrasted with the emulsified water.

The entire bed of ion exchange beads should be treated with the resin. This can be readily determined by examining the effluent from the bed during the process and stopping the introduction of solidification resin when the effluent comprises a suitable curable resin or emulsion. The first fluid to exit from the bed will be free water. Following this, an emulsion of resin and water will exit. If sufficient resin is forced through the bed, eventually pure precatalyzed-promoted resin will exit. However, it is not necessary to employ this quantity of resin since the emulsified form is satisfactory for encapsulation of the ion exchange beads. The emulsified form is substantially the same as that disclosed in U.S. Pat. Nos. 4,077,901 and 3,792,006. The parameters disclosed in these two patents are suitable for use herein in respect to the maximum ratio of water to resin and ion exchange beads, catalysts, promoters, etc., which can be employed herein. The teachings of these two patents are therefore specifically incorporated herein by reference.

Containers, such as ion exchange columns, e.g., demineralizers, containing one or more inlets for the introduction of the solidification resin and one or more exits to permit liquids to be removed are satisfactory. They normally contain a means for maintaining the beads in the column when subjected to a flow of a fluid therethrough. Restraining means such as screens, slotted gathering tubes, etc. of suitable sized openings can be employed for this purpose. The process of the present invention can be carried out in standard ion exchange beds or the ion exchange beads can be transferred to a separate container which is equipped with suitable inlets and outlets. The size and shape of the container, e.g., rectangular, round, etc., is not critical to the practice of the invention. The solidification resin is either pumped through the bed under pressure or drawn through by vacuum. The pressure and/or vacuum value is dependent only on the capacity of the equipment employed. Both a vacuum and positive pump pressure can be employed. The method employed is not critical to the practice of the invention and will depend on the specific design of the column, the equipment available at the site of use and the like. The solidification resin can be pumped through from top to bottom or from bottom to top.

Once the desired amount of solidification resin is placed into the bed, the resin is permitted to cure in-situ to form an essentially liquid free monolith. The container along with the encapsulated ion exchange beads can then be disposed of in any suitable manner.

The following vinyl ester resins were utilized in the Examples:

Resin A

Bisphenol A was catalytically reacted with D.E.R. ® 331 epoxy resin at 150° C. under a nitrogen atmosphere for 1 hour to form a polyepoxide having an epoxy equivalent weight (EEW) of 535. After cooling to 110° C. additional D.E.R ® 331 was added with methacrylic acid and and hydroquinone and reacted to a carboxyl content of about 2.5–3 percent. Then maleic anhydride was added to the vinyl ester resin and reacted therewith. The final resin was diluted with 50 percent by weight of styrene monomer. The resin formulation had a viscosity of about 300 centipoise.

D.E.R. ® is the diglycidyl ether of bisphenol A having an epoxy equivalent weight of 182–190.

Resin B

This resin was formulated in a similar manner as for Resin A except that it did not contain maleic anhydride and had a lower EEW and a viscosity of about 125 centipoise.

Resin C

A vinyl ester resin was prepared by reacting a 1 equivalent of methacrylic acid with 0.75 equivalent of an epoxy novolac having an epoxide equivalent weight (EEW) of 175–182 (D.E.N. ® 438 epoxy novolac) and 0.25 equivalent of a glycidyl polyether of bisphenol A having an EEW of 182–190 (D.E.R. ® 331). The above reactants were heated to 115° C. with catalyst and hydroquinone present until the carboxylic acid content reached about 1 percent. The reactants were cooled and then diluted by adding about 45 percent by weight of styrene (containing 50 ppm of t-butyl catechol). The final resin composition had a viscosity of about 75 centipoise.

The viscosities of the resins are determined at 77°F. employing a Brookfield Viscometer.

EXAMPLE 1

A demineralizer consisting of a carbon steel tank, 24 inch inside diameter×72 inch high, dished on both ends, with a "brush-off," sand blasted internal surface was employed. Three 1½ inch fittings at the top of the tank provided a center top fill distributor, a connection to bottom gathering lines, and a top vent. The gathering lines at the bottom were composed of PVC (polyvinyl chloride resin) plastic pipe having slots to accept liquid but not the beads. The total volume of the container was about 18 cu. ft.

The demineralizer was filled with spent beads consisting of nonradioactive spent cation and anion exchange beads obtained from a commercial fossil fuel power plant. The ion exchange beads filled the entire demineralizer except for a void head space of about 3 ½ inches at the top of the container. The diffuser projected into the top of the bed. Tap water was first circulated through the demineralizer from the diffuser at the top. A specific conductivity measurement was made of the water after passing it through the demineralizer bed. It read 270 ohms or 3,700 micromhos (mmhos). The untreated tap water had a reading of 600 ohms or 1,670 mmhos. The pH was 7.0. This indicated that the beads in the bed were essentially spent prior to placement of the solidification resin.

A progressive cavity Moyno FS44C pump was used to circulate the tap water and to inject the resin for solidification. The pump discharge pressure was used to force liquid through the bed and overflow through the gathering line outlet.

A total of 58 gallons of a vinyl ester Resin B was mixed with two parts of a catalyst (a 40 percent by weight benzoyl peroxide emulsion in diisobutyl phthalate sold by Noury Chemical Corporation under the trade name CADOX 40E, (hereinafter referred to as benzoyl peroxide) and 0.05 parts of a promoter, dimethylaniline (hereinafter DMA), in an open topped drum.

The process of encapsulating the ion exchange bed then proceeded as follows:

| Time (min.) | |
|---|---|
| 0 | 53 gal. of resin mixed with catalyst and promoter |
| 3 | Pumping resin into demineralizer - 1.5 gpm @ 5 psig |
| 4 | Head space filled - vent closed - 1.5 gpm @ 5 psig |
| 5 | 7 gal. of resin pumped into demin. - 1.5 gpm @ 5 psig |
| 6 | 9 gal. of resin pumped into demin. - 1.5 gpm @ 10 psig |
| 8 | 11 gal. of resin pumped into demin. - 1.5 gpm @ 10 psig |
| 10 | 15 gal. of resin pumped into demin. - 1.5 gpm @ 10 psig |
| 20 | 36 gal. of resin pumped into demin. - 1.5 gpm @ 20 psig |
| 20 | Stop - Mixed 5 more gal. resin mixture in drum |
| 24 | 38 gal. of resin pumped at 1.5 gpm and 15 psig - $H_2O$ overflow* |
| 27 | 42 gal. of resin pumped at 0.5 gpm and 20 psig - $H_2O$ overflow |
| 30 | 44 gal of resin pumped at 0.5 gpm and 20 psig - $H_2O$ overflow |
| 36 | 48 gal. of resin pumped at 0.5 gpm and 20 psig - Binder + $H_2O$ overflow |
| 39 | 50 gal. of resin pumped at 0.5 gpm and 20 psig - Near all binder overflow |
| 53 | 55 gal. of resin pumped at 0.5 gpm and 20 psig - All binder overflow |
| 67 | 58 gal. of resin pumped at 0.5 gpm and 20 psig - All Stop |

*Overflow was from the third outlet on top of container.

Samples of overflow were collected at 36 min., 38 min., 40 min., 42 min., 49 min., 52 min., 55 min., 60 min., 68 min., to check cure and product. First cure in samples 60 and 68 were noted at 2 hours, 20 min. Prior to conducting the encapsulation process, an internal thermocouple was located in center of the bed (through a $\frac{1}{8}$ inch diameter hole) and an external thermocouple was taped to the outer wall at center. These are used to monitor the exotherm generated by the resin system. The temperature readings during the process were recorded and reported in the following Table I.

TABLE I

| Time (Min.) | Internal °C. | External °C. |
|---|---|---|
| 60 | 24 | 18 |
| 90 | 24 | 18 |
| 120 | 25 | 19 |
| 180 | 26 | 22 |
| 240 | 39 | 33 |
| 300 | 59 | 34 |
| 360 | 64 | 34 Maximum $\Delta T = 40°$ C. |
| 24 hours | 48 | 25 |
| 40 hours | 39 | 25 |

After curing for 24 hours, the steel demineralizer was cut away from the bed. The bed was examined and found to be a uniform solidified mixture of beads and resin. It could only be cut into pieces with difficulty employing a chain saw. Product quality was excellent throughout and no free liquid was observed. The ion exchange beads were distributed evenly throughout the solidified mass.

EXAMPLE 2/COMPARATIVE TEST 2

A 1.2 inch inside diameter glass column 15 inches long was stoppered at the bottom end with a number $6\frac{1}{2}$ plug fitted with a glass tube which was connected to a vacuum pump. The column was vertically mounted and packed first with mixed ion exchange beads (cationic and anionic ion exchange beads) composed of one to one equivalent mixture (by weight) of DOWEX® HCR-S cation resin beads (hydrogen form) and DOWEX® SBR anion resin beads (hydroxyl form) to a height of about 7.9 inches. Next a 1.1 inch layer of activated charcoal (minus 50 plus 200 mesh U.S. Standard Sieve Series) was placed on top followed by about a one inch layer of the mixed ion exchange beads to keep the activated charcoal from floating. Neither the beads nor the carbon were spent. The bed was wet with water by pouring water into the top of the column and drawing it through with a vacuum applied to the glass tube located through the plug at the bottom of the column. A mixture of Resin A, 0.25% of benzoyl peroxide catalyst and 0.02 ml of a promoter, N,N-dimethyl-p-toluidine (hereinafter DMT), was forced through the bed by pouring it into the top of the tube and sucking it through the bed by applying a vacuum to the column through the bottom. The resin failed to set up. A solidification resin mixture of this type will normally gel within about 15–30 minutes.

A second column (the same size as above) was packed with a uniform mixture of coarser charcoal (−12+20 mesh) and mixed ion exchange beads as described immediately hereinbefore. In this instance the bed was first spent by passing a mixture of the promoter DMT and acetone through the column. A mixture of the same resin but containing 0.5% of the catalyst and 0.04 ml of the promoter was then forced through the column. The sample gelled in about 25 minutes and successfully cured to a uniform solidified mixture of beads and resin.

When conducting actual field work, preliminary tests of the type set forth directly hereinbefore can be run to determine the parameters necessary to assure successful encapsulation of many types of ion exchange beads employed in many water treatment processes.

EXAMPLE 3

A carbon steel tank 43 inches in diameter by 63 inches deep was employed to hold ion exchange beads. The top of the tank was open and contained no inlet or outlet connections. Windows were installed on two sides of the tank by burning slots 1 inch wide by 12 inches long (vertically), offset laterally 6 inches between slots, with several inch overlap on each end of the slot with the adjacent slots. This arrangement permitted observation of liquid fill of the tank on opposed sides from top to bottom of the vertical walls. Plexiglas was then installed over each slot and sealed with a silastic rubber sealant.

PVC (polyvinyl chloride) piping containing slots was installed as gathering lines at the bottom of the tank. A distribution header was installed at the top of the tank. The gathering line legs connected to a main pipe extending down through the bed. The distribution head consisted of a manifold having eight smaller pipes extending horizontally above the top of the bed. The pipes contained small holes to permit the distribution of the solidification resin over the top of the ion exchange bed.

The tank was filled to a depth of 52 inches (about 52 cubic feet) with spent ion exchange beads consisting of mixed cation-anion exchange beads obtained from a fossil fuel power plant. Tap water was flowed through the bed for a period of several hours to simulate commercial use of a bed. The beads were compacted to 50 inch depth - about 50 cu. ft.

In order to assure that the beads were spent, 35 pounds of NaOH was dissolved in the circulating water.

This was done so that the chemical activity of the beads would not interfere with the promoter.

A pneumatic diaphragm pump was used to remove the water from the demineralizer (for circulation and/or evacuation) through the gathering lines at the bottom of the ion exchange bed.

A progressive cavity pump was used to furnish the water stream and resin to the top of the ion exchange bed through the distribution header.

A vacuum pump was used to apply a differential pressure on the resin during the in-situ fill of the ion exchange bed. This pump was connected to an 18 cu. ft. surge tank which in turn was connected to the pipe leading to the gathering lines at the bottom of the demineralizer.

450 Pounds of vinyl ester Resin B were dispensed into an open topped 55-gallon drum and mixed with benzoyl peroxide catalyst and DMA promoter. Three batches of this mix were prepared. Mixing was conducted with a Lightnin mixer-NLDG-300 of 3 horsepower. The resin mixture consisted of 100 parts by volume resin, 2 parts by volume catalyst, and 0.05 parts by volume promoter.

The resin mixture was introduced through the distributor head onto the top of the bed and pulled through the bed from top to bottom by application of a vacuum to the gathering lines at the bottom of the tank. The time sequence of the in situ solidification is set forth below.

| Time (Min.) | |
|---|---|
| 0 | 1st drum of resin mixed with catalyst and promoter |
| 1 | started in-situ fill of bed |
| 10 | 2nd drum of resin mixed - 5% vacuum applied |
| 13 | Resin 9 inches into bed |
| 16 | Resin 13 inches into bed |
| 18 | 3rd drum of resin mixed and being pumped |
| 19 | Resin 16 inches into bed - 10 inches vacuum applied |
| 23 | Resin 19 inches into bed - 23 inches vacuum applied |
| 26 | Resin 22 inches into bed |
| 29 | Resin 24 inches into bed |
| 34 | Resin 31 inches into bed - Heavy $H_2O$ exit to surge tank |
| 38 | Resin 36 inches into bed - intermittent $H_2O$ exit to surge tank. |
| 44 | Resin >40 inches into bed - Intermittent $H_2O$ exit to surge tank |
| 45 | Exit $H_2O$ appears to have oil at top of horizontal sight glass |
| 48 | Exit $H_2O$ appears to have amber tinge (resin is amber) |
| 49 | Exit $H_2O$ appears milky |
| 51 | Exit $H_2O$ appears milky with amber tinge |
| 54 | Exit $H_2O$ appears milky near emulsion |
| 54 | Exit $H_2O$ is now an emulsion - steady flow |
| 55 | 3rd drum of resin now empty. 3 Inch of prepared resin is observed on top of bed |
| 90 | Resin removed from surge tank has gelled |
| 105 | Thermocouples are inserted into bed - 18° C. and following sequence of temperature were recorded |
| 135 | 21° C. |
| 165 | 24° C. |
| 195 | 29° C. |
| 225 | 37° C. |
| 255 | 49° C. |
| 285 | 55° C. |
| 300 | 56° C. Maximum with ΔT 38° C. |

About 24 hours following the introduction of the resin, two ½-inch holes were drilled into the base of the bed. The drill shavings were dry and no liquid was produced evidencing the fact that the process had dewatered and emulsified some of the free water which was in the bed at the start of the process. The steel container was cut away from the bed with a cutting torch exposing a uniform solidified mixture of beads and resin. Three pie-shaped sections were cut out of the bottom of the monolith with a chain saw.

Where the steel tank was lined with a baked phenolic lining, the surface of the solidified mixture was smooth and hard. Where the tank had been patched (removal of manway and other piping) with a carbon steel plate, the resin apparently bonded to the carbon steel leaving a rough texture surface on the solidified mixture in those areas. The area between the gathering line and the bottom of the shell contained spots of incompletely cured resin, but no water, when the shell was removed. These spots did polymerize during the next two days. The solidified mixture exhibited no free liquid.

EXAMPLE 4

A simulated demineralizer was prepared from clear plastic tube material. The simulated demineralizer consisted of an outside tube closed at the bottom, approximately 9 inches tall and 6 inches in diameter. Placed concentrically inside the first tube was a second tube approximately 2 inches in diameter and 8 inches tall. The second tube was bonded to the bottom of the larger tube by a solvent. Two copper tubes were placed in the annular space formed between the outside tube and the inside tube and one copper tube was placed in the center of the inner tube. The tubes extended vertically from the top to the bottom of the container. They contained small holes at the bottom which permitted the flow of fluids but not ion exchange beads or activated charcoal therethrough.

In the first test the demineralizer was filled with 410 grams of activated charcoal (Calgon Filter Sorb 400 minus 12 plus 40 mesh U. S. Standard Sieve Series) and 1490 grams of spent mixed ion exchange beads containing both cationic and anionic ion exchange beads obtained from a fossil fuel power plant. The annular space and the inside of the smaller tube were filled essentially evenly with the materials. The charcoal covered the bottom portion of the demineralizer to a height of about 2¼ inches and the spent ion exchange beads extended approximately 4¾ inches above the charcoal. 1770 Milliliters of water were added to the demineralizer to bring the height of water to approximately 1½ inches above the top of the spent ion exchange bed contained in both the annular space between the tubes and in the inside tube.

To simulate the dewatering of a typical ion exchange bed, vacuum was applied to the three tubes and water was drawn off the bed. The dewatering process was continued for about 13.75 minutes. During the dewatering step a solidification resin was prepared containing 2000 milliliters of vinyl ester Resin A; 50 ml of benzoyl peroxide catalyst and 2 ml of DMT. The solidification resin was poured into the tank from the top using a distributor pan so as to cover the top of the ion exchange beads contained both in the inner tube and in the annular space. It took about 4 minutes to pour the resin into the demineralizer. The resin was pulled through the ion exchange beads and activated carbon from top to bottom by application of vacuum to the three copper tubes previously described. After about 5.2 minutes, the resin had been completely pulled through the bed leaving about 1 inch of free resin at the top of the bed. Additional free water was pushed from the bed by the plug of resin flowing therethrough and collected in a trap. The temperature during the cure of the resin was measured to be 63.5° C. in the center of the ion exchange bed. The temperature of the 1 inch layer on top reached about 145° C. After the resin had cured, the bottom of the container was pried off. A uniform solidified mixture of ion exchange beads, charcoal and resin had been formed. The 1 inch material at the top of the bed had cracked from binder shrinkage. The higher temperature in this layer is caused by the lack of a heat sink of either emulsified water or ion exchange beads.

In the second simulated test, a similar demineralizer was filled with 410 grams of the same type of activated charcoal and 1650 grams of the same type of spent ion exchange beads. The bed was filled with approximately 1900 grams of water. The bed was then dewatered in the same manner as described above for about 30 minutes. A solidification resin was prepared containing 2000 ml of the vinyl ester Resin A, 50 ml of the same catalyst and 1.6 ml of DMT. Following the dewatering step the resin was drawn through the ion exchange bed in the same manner as in the first test. It took approximately 5 minutes to pull the resin through the two beds of material. Additional free water was pushed from the bed by the solidification resin. Because of the additional quantity of ion exchange beads employed, no free resin was present on the top of the bed as in the first test. The temperature of the solidification resin and beads near the wall of the center chamber reached about 53.5° C. during the cure. The resin cured to form a uniform solidified mixture of beads and resin which was sawed in half. No free liquid was observed and both the beads and the charcoal, except at the interface of the charcoal and beads, had cured completely into a uniform block. In these simulated demineralizer tests, the solidifaction resin was flowed from top to bottom of the demineralizer bed successfully removing water and solidifying the bed.

In other tests employing an activated charcoal having −12+20 mesh size and obtained from another source, the charcoal could not be solidified employing similar resin systems even when the charcoal had been pretreated with acetone and lubricating oil. Activated charcoals seem to differ to such a degree that each type must be tested to determine whether they can be solidified by practicing the principles of the invention described herein.

EXAMPLE 5

A simulated demineralizer of a different design was prepared. In this example, a clear plastic tube approximately 36½ inches long and 4 inches inside diameter was closed at both ends. A one-half inch diameter PVC pipe was inserted through the top and extended to the bottom of the columm. The pipe contained a fritted end at the bottom to permit the passage of water and solidification resin, but not ion exchange beads. A 40 mesh stainless steel screen was placed near the bottom of the column above the fritted end of the pipe leaving an open space of about one inch. The column was then charged with approximately 32¾ inches of spent mixed ion exchange resin beads obtained from a fossil fuel power plant. A second screen was placed on top of the bed approximately 1 inch from the top of the column. A second port was provided in the top through which extended a one-half inch PVC tube, the open end of which was positioned close to the top screen. The column was filled with water and the water was then removed by the application of a vacuum to the center pipe. A solidification resin was prepared composed of 2500 grams of Resin C, 62.5 ml of benzoyl peroxide catalyst and 1.25 ml of DMA. The resin was introduced through the column by pouring it through the center pipe and applying a vacuum to the tube extending through the second port located at the top of the column. The resin flowed down through the pipe, out the fritted end and up through the bed. As the resin was being introduced through the bed in plug flow, one could visually see it pushing additional free water ahead of it and out of the port where the vacuum was being applied. The resin flowed through the resin bed with a substantially even front. The ion exchange beads were not moved by the introduction of the resin through the bed. It took approximately 32.5 minutes to inject the resin through the entire height of the bed. The resin was permitted to cure in the bed and the column so formed was then cut into quarters lengthwise. The ion exchange beads were uniformly distributed throughout the solidified mixture of beads and resin.

Another test was run on an identically designed simulated demineralizer employing different solidification resins. A solidification resin was prepared consisting of vinyl ester Resin A, 3000 ml; benzoyl peroxide catalyst, 75 ml; and DMA, 1.5 ml. The resin was introduced into an ion exchange bed in the same manner as previously described to successfully solidify and cure it to form a uniform solidified mixture of beads and resin.

Still another resin consisting of 3000 ml of vinyl ester Resin B, 75 ml of benzoyl peroxide catalyst and 1.5 ml of DMA was employed in a similar column with equally successful results.

EXAMPLE 6

A 6 inch diameter clear plastic simulated demineralizer was prepared having the same dimensions, except for the diameter, and beads as that set forth in Example 5. In this example the solidification resin consisted of 6000 ml of vinyl ester Resin B, 150 ml of benzoyl peroxide catalyst and 9 ml of DMA. Following the format set forth in Example 5, the column was first dewatered and then the resin introduced through the pipe located in the center down to the bottom of the column and up through the ion exchange beads. After permitting the resin to cure, the column was sawed in half. The spaces between the ion exchange beads were completely filled with the resin and the solidified column of beads was very hard and uniform.

EXAMPLE 7

A 10 inch diameter simulated demineralizer column was prepared having the same dimensions as that set forth in Examples 5 and 6 except for the diameter. It was filled with the same type of ion exchange beads as employed in Example 5. The bed was solidified in the same procedure as previously described in Example 5. The solidification resin consisted of 17,107 ml of vinyl ester Resin B, 428 ml of benzoyl peroxide and 20 ml of DMA. After permitting the resin to cure the column was sawed in half lengthwise. An air pocket was observed in the bottom which had filled with neat resin. The entire column of ion exchange beads including the spot of neat resin was uniformly solidified.

EXAMPLE 8

A 24 inch long column having a 2 inch inside diameter of clear polyvinyl chloride plastic was prepared in the following manner. The lower end was cut with grooves and fitted with a 40 mesh stainless steel screen which permitted fluid to flow therethrough. The column was filled with approximately 24 inches of spent ion exchange beads obtained from a fossil fuel power plant. The top was sealed with a 40 mesh stainless steel screen and a PVC cap which contained a 1 inch port through which extended a small section of pipe. The column was filled with water and permitted to sit overnight. Some of the free water was then pulled off by applying a vacuum to the pipe located at the top of the column. The column was then set into a one quart can. A solidification resin consisting of 1000 ml of vinyl ester Resin B; benzoyl peroxide catalyst, 25 ml; and DMA, 1.5 ml was premixed. The solidification resin was placed in the one-quart container in which the column was sitting. A vacuum was applied to the top of the column and the resin was drawn through the column in approximately 12.5 minutes. The resin gelled in about 16 minutes. After permitting the resin to cure, the solidified beads were removed intact from the column as a solid column. The column was cut into 6 pieces. Three pieces were approximately 3 to 3½ inches in length and three pieces were approximately 4 inches long.

Each of the pieces were weighed and numbered. This data is set forth in the following Table II.

TABLE II

| Piece No. | Grams | Compressive Strength (PSI) Yield | Maximum |
|---|---|---|---|
| 1 | 198.3 | — | 1920 |
| 2 | 190.6 | — | — |
| 3 | 217 | — | — |
| 4 | 242.5 | 1178.6 | 2400 |
| 5 | 245.1 | — | — |
| 6 | 244.95 | 1018.9 | 2440.5 |

Three of the pieces (Nos. 1, 4 and 6) were then selected for compressive strength tests employing an Instron Universal Testor Model 1125 run at a cross head speed of 0.05 inches per minute. The results are also set forth in Table II.

EXAMPLE 9

In this example ion exchange beads were obtained from an operating nuclear power station. They were composed of a mixture of ion exchange beads (cation and anion) obtained from two operating nuclear power plants and contaminated with radioactive ions. A column was prepared of clear polyvinyl chloride. The column was approximately 24 inches long and had an inside diameter of 2 inches. The column was left open at the bottom which had been cut in a jagged manner and fitted with a screen to permit the drawing of resin through the column in an upward direction. The top was fitted with a 40 mesh stainless steel screen and cap containing an exit port to which a vacuum was applied to draw the resin through the column. The column was marked at 3 inch intervals, numbered from bottom to top and filled with the radioactive ion exchange beads. The column was surveyed with a Geiger counter at each 3 inch segment and a radiation dose recorded at each segment. The ion exchange bed was then washed with 300 ml of deionized water and then surveyed again. A solidification resin was prepared containing 1000 ml of vinyl ester Resin B, 25 ml of benzoyl peroxide catalyst, and 1.5 ml of DMA. The column was set in a quart pail as described in Example 8. The solidification resin was placed in the quart pail and the resin drawn through the column from bottom to top by the application of a vacuum to the exit port located at the top of the column. The resin gelled in about 23.5 minutes. After the temperature of the cured solidification resin had returned to approximately room temperature, the column was again surveyed. The results of these surveys are set forth in the Table III below. The radiation measurements are in millirems.

TABLE III

| Column No. | Radiation of Column After Filled | Radiation of Column After Deionized Water Wash | Radiation of Column After Solidification |
|---|---|---|---|
| 1 | 55 | 35 | 30 |
| 2 | 60 | 37 | 42 |
| 3 | 65 | 50 | 47 |
| 4 | 55 | 48 | 50 |
| 5 | 45 | 40 | 45 |
| 6 | 35 | 30 | 35 |

The solidified ion exchange bed was removed from the polyvinyl chloride pipe and cut into 3 inch long segments with a hacksaw. Each segment was cleaned of dust caused by the saw and each end of the cut pieces was then sealed with a thin film of the resin formulation employed to solidify and encapsulate the bed.

Column specimen Nos. 2, 3, 4 and 5 were weighed, radioactivity measured, and then placed in separate 16 ounce bottles. 250 Ml of deionized water was added to specimen nos. 2 and 3. Specimens 4 and 5 were submerged in a simulated seawater solution (Instant Ocean mix employed for salt water fish) having a specific gravity of approximately 1.024 at 68° F. Tests were run to observe the leaching of Cesium-137 and Cobalt-60 from the samples. The leach water was changed daily except for the weekends and when the leach rate stabilized, they were changed less often. The leach water was checked for the indicated ions employing an Ortec Model 6200 Multichannel Analyzer. The leach rate data on these specimens is set forth in the FIGURE.

EXAMPLE 10

The solidification of an ion exchange bed with a polyester resin was conducted in the following manner. A polyethylene bottle having an inside diameter of about 2⅜ inches and about 6⅝ inches long was employed as the container. Holes were drilled in the bottom (0.0420 inch diameter) and the bottle was filled with a spent mixture of cationic and anionic ion exchange beads obtained from a fossil fuel plant. The beads were dewatered by permitting free water to drain from the holes in the bottom of the bottle. A vacuum line was attached to the neck of the bottle. A polyester resin formulation was prepared containing 400 gm of a 50/50 (by weight) mixture of styrene monomer and an unsaturated polyester resin (commercially available as COREZYN 158-5 from Interplastic Corp.); 10 milliliters of benzoyl peroxide catalyst, and 0.6 ml of DMA. This resin formulation having a viscosity similar to that of Resin B, was placed in a quart can and the previously prepared ion exchange bed was placed into the resin mix. The solidification resin was pulled up through the ion exchange bed by application of vacuum at the neck of the polyethylene bottle. About 350 ml of the solidification resin was employed: 220 ml remained in the ion exchange bed and 130 ml was collected in a trap located in the vacuum line. The resin was permitted to cure overnight and then the polyethylene bottle was removed from around the solidified ion beads. The solifified bed was cut in half to reveal a uniform hard cylinder which felt slightly damp to the touch but no free liquid was observed thus evidencing a successful solidification of the ion exchange beads.

EXAMPLE 11

A 55 gallon drum, about 22.5 inches in diameter and 34 inches deep, was employed to contain and solidify ion exchange beads in the following manner. A 40 mesh stainless steel screen was welded inside the drum about 2 inches from the bottom. A one inch diameter pipe was located in the center of the drum and extended through the bottom screen to the bottom of the drum. The bottom end of the pipe was sealed and contained small holes to permit the passage of fluids. The drum was loaded with a mixture of ion exchange beads consisting of about one part by weight of DOWEX® SBR (chloride form) and two parts by weight of DOWEX® HCR-S (sodium form). The beads rested on the bottom screen and filled the drum to a line about 6 inches from the top. A second screen was then positioned on top of the bed and spot welded to hold the screen in place. A side port was made in the side of the drum in the 6 inch open space at the top. The drum was sealed with a lid which had plexiglass observation ports. The 1 inch pipe extended through the center of the lid. The drum was filled with water and then a resin formulation consisting of 30 gallons of Resin B, 3407 grams of benzoyl peroxide catalyst and 171 milliliters of DMA was introduced into the drum through the center pipe. A vacuum of 25 inches was applied to the side port to pull the resin from the bottom to the top of the bed. The resin was pulled through the bed in about 10.5 minutes. The resin cured to a rock-like hardness with the ion exchange beads evenly distributed therethrough.

EXAMPLE 12

A rectangular container was prepared composed of a square column, about $2\frac{5}{8}$ inches on a side and 33.5 inches long. The bottom was closed off and connected to a vacuum pump through one quarter inch tubing. The column was filled with cation DOWEX® HCR-S (sodium form) beads to a height of about 30 inches. A resin formulation composed of 2000 ml of Resin B; 24 ml of benzoyl peroxide catalyst; and 4 ml of DMA was mixed and poured into the top of the column and drawn through by application of a vacuum at the bottom. The ion exchange bed had first been pre-wet with water by drawing water through the column. When the resin formulation was drawn through, water exited after about 4.5 minutes and the resin started to exit after about 12 minutes and 58 seconds. The introduction of the resin was discontinued after about 20 minutes and 20 seconds. After about 24 hours, a cured column was removed from the mold. A very good square post of solidified ion exchange beads was produced.

EXAMPLE 13

In this example, a rectangular container was prepared having the following dimensions: 12 inches wide by 24 inches long by 18 inches deep. A one inch diameter drain was placed in the bottom in one corner and leveling bolts were placed on the side and end opposite to the drain in order to obtain a slope toward the drain. The container was filled with a DOWEX® HCR-S (sodium form) ion exchange bead slurry to about 12 inches deep with the water leveling at 3 to 4 inches above the height of the ion exchange beads. The leveling bolts were adjusted to give a one quarter inch slope on the 12 and 24 inch sides toward the drain. A vacuum line was then attached to the drain and the ion exchange beads were dewatered by application of a vacuum to the container until only air was being drawn. A resin formulation, comprised of two batches each containing the following constituents, was prepared: 38.9 pounds of Resin B; 176.7 grams of benzoyl peroxide catalyst; and 38 ml of DMA. The resin formulation was poured into the container to cover the top of the ion exchange bed. A vacuum was applied to the drain and the first resin exited after about 8 minutes. The vacuum was turned off after about 16 minutes. After about 72 hours, a solidified monolith of ion exchange beads conforming essentially to the shape of the container was removed therefrom.

What is claimed is:

1. A method of solidifying an ion exchange bed composed of ion exchange beads which has been employed to remove ionic species from an aqueous solution which comprises:

(a) introducing into and through the ion exchange bed contained in a container a sufficient quantity of a liquid solidification resin comprising a vinyl ester resin, an unsaturated polyester or a mixture of the two, and a suitable catalyst to cause the resin to cure, to intermix with and encapsulate said ion exchange beads in said container, said resin mixture being flowed through the bed in plug flow, and (b) curing said resin in situ in said container to thereby form a uniform solidified mixture of said beads and resin in said container.

2. The method of claim 1 wherein the ion exchange bed contains free water and a sufficient quantity of resin is introduced into and through said bed to force a substantial portion of said free water out of the bed.

3. The method of claim 1 wherein the ion exchange bed contains radioactive ions.

4. The method of claim 1 wherein the resin comprises a vinylester resin prepared by reacting about equivalent amounts of an unsaturated monocarboxylic acid and a polyepoxide resin, said vinyl ester resin containing

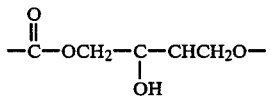

linkage groups and terminal vinylidene groups attached to the ester end of said linkage, and said catalyst consists of a peroxide or a hydroperoxide catalyst.

5. The method of claim 1 wherein the ion exchange bed initially contains free water and the liquid precatalyzed resin has a viscosity of about 40 to about 1000 centipoise.

6. The method of claim 4 wherein the solidification resin includes in addition a promoter which functions to initiate the cure of said resin.

7. The method of claim 1 wherein the presolidification resin includes in addition a promoter which functions to initiate the cure of said resin.

8. The method of claim 1 wherein the resin is an unsaturated polyester.

9. The method of claim 1 wherein the container is rectangular.

10. The method of claim 1 wherein the solidification resin includes in addition from about 60 to about 30 percent by weight of a copolymerizable monomer.

11. The method of claim 10 wherein the copolymerizable monomer is styrene.

12. The method of claim 11 wherein the ion exchange bed initially contains free water and the liquid solidification resin has a viscosity of from about 40 to about 1000 centipoise.

13. A method of solidifying an ion exchange bed composed of ion exchange beads contained in a container which has been employed to remove radioactive ions from an aqueous solution which comprises:

(a) introducing into said container and through said ion exchange bed in plug flow a liquid solidification resin comprising a vinyl ester resin, an unsaturated polyester or a mixture of said two resins, from about 30 to about 60 percent of a monomer which is polymerizable with said resin, a sufficient quantity of a catalyst which causes the resin to cure to a solid monolith after said bed has been encapsulated by said resin, and a sufficient quantity of a promoter which functions to initiate the cure of said resin, said solidification resin being employed in an amount sufficient to encapsulate the entire bed; and (b) curing said resin in situ in said containter to form a uniform solidified mixture of said beads and said resin in said container.

14. The method of claim 13 wherein the liquid solidification resin has a viscosity at room temperature of about 40 to about 1000 centipoise.

15. The method of claim 13 wherein the container is rectangular.

16. The method of claim 13 wherein the resin is a thermosetting vinylester resin, the copolymerizable monomer is styrene, the catalyst is a peroxide or hydroperoxide, and the promoter is selected from the group consisting of lead naphthenate, cobalt naphthenate, dimethylaniline or N,N-dimethyl-p-toluidine.

17. The method of claim 13 wherein the resin is a thermosetting unsaturated polyester, the monomer copolymerizable therewith is styrene, the catalyst is a peroxide or a hydroperoxide and the promoter is selected from the group consisting of lead naphthenate, cobalt naphthenate, dimethylaniline or N,N-dimethyl-p-toluidine.

18. A method of removing free water from a spent ion exchange bed composed of ion exchange beads and solidifying said bed, said bed being contained in a container, which comprises:

(a) introducing into and through the ion exchange bed in plug flow a sufficient quantity of a liquid solidification resin comprising a vinyl ester resin, an unsaturated polyester or a mixture of the two and a catalyst to cause the resin to cure, to force free water from the bed and intermix with and encapsulate said ion exchange beads with said resin in said container; and (b) curing said resin in situ in said container to thereby form a uniform solidified mixture of said beads and resin in said container.

19. The method of claim 18 wherein the container is rectangular.

20. The method of claim 18 wherein said resin is a vinyl ester resin in admixture with from about 30 to about 60 percent by weight of a copolymerizable monomer.

21. The method of claim 20 wherein the copolymerizable monomer is styrene.

22. The method of claim 18 wherein the resin is an unsaturated polyester in admixture with from about 30 to about 60 percent by weight of a copolymerizable monomer.

23. The method of claim 22 wherein the copolymerizable monomer is styrene.

* * * * *

Disclaimer and Dedication 4,585,583.—*Keith Roberson*, Freeland; *Don L. Stevens*, Sanford; *Harold E. Filter*, Midland, all of Mich. IN SITU SOLIDIFICATION OF ION EXCHANGE BEADS. Patent dated Apr. 29, 1986. Disclaimer and Dedication filed Dec. 18, 1989, by the assignee, The Dow Chemical Company.

Hereby disclaims and dedicates to the Public all claims of the said patent.

[ *Official Gazette April 24, 1990* ]